US011859487B2

(12) United States Patent
Gillan

(10) Patent No.: US 11,859,487 B2
(45) Date of Patent: Jan. 2, 2024

(54) DEVICES, SYSTEMS AND METHODS TO CALCULATE SLIDE STABILITY

(71) Applicant: Nabors Drilling Technologies USA, Inc., Houston, TX (US)

(72) Inventor: Colin J. Gillan, Houston, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 1310 days.

(21) Appl. No.: 16/157,709

(22) Filed: Oct. 11, 2018

(65) Prior Publication Data

US 2020/0116010 A1 Apr. 16, 2020

(51) Int. Cl.
*E21B 47/024* (2006.01)
*E21B 44/00* (2006.01)
*E21B 7/06* (2006.01)

(52) U.S. Cl.
CPC ..... *E21B 47/024* (2013.01); *E21B 7/068* (2013.01); *E21B 44/00* (2013.01)

(58) Field of Classification Search
CPC ..... E21B 47/024; E21B 7/068; E21B 44/00; E21B 47/02; E21B 7/06
See application file for complete search history.

(56) References Cited

U.S. PATENT DOCUMENTS 8,510,081 B2 8/2013 Boone et al.
8,672,055 B2 3/2014 Boone et al.
9,290,995 B2 3/2016 Boone et al.
9,784,035 B2 10/2017 Boone et al.
9,784,089 B2 10/2017 Boone et al.
10,094,209 B2 10/2018 Gillan et al.
2009/0090555 A1 4/2009 Boone et al.
2011/0024191 A1* 2/2011 Boone ..... E21B 7/04 175/45
2014/0151121 A1 6/2014 Boone et al.
2014/0158428 A1 6/2014 Boone et al.
2015/0233229 A1* 8/2015 Benson ..... E21B 47/026 700/275
2016/0145993 A1 5/2016 Gillan et al.
2016/0237802 A1 8/2016 Boone et al.
2016/0305230 A1* 10/2016 Benson ..... E21B 7/04
2017/0243383 A1* 8/2017 Gillan ..... G06T 11/00
2018/0003026 A1 1/2018 Boone et al.
2018/0266245 A1 9/2018 Gillan et al.

OTHER PUBLICATIONS

Arthor unknown, Directional (Circular) Statistics, retrieved from the Internet Oct. 9, 2018, url: http://webspace.ship.edu/pgmarr/Geo441/Lectures/Lec%2016%20-%20Directional%20Statistics.pdf, 41 pages.

* cited by examiner

*Primary Examiner* — Andrew Schechter
*Assistant Examiner* — Jeremy A Delozier
(74) *Attorney, Agent, or Firm* — Haynes and Boone, LLP

(57) ABSTRACT

Systems, devices, and methods for measuring toolface angles on a drilling rig and calculating a slide stability score are provided. The slide stability score may represent an amount of consistency of the toolface angle of a bottom hole assembly (BHA) of the drilling rig during a slide drilling operation. Calculating the slide stability score may include measuring one or more toolface angles of the BHA during the slide drilling operation, comparing the measured one or more toolface angles, and calculating the consistency of the toolface angle using the measured one or more toolface angles.

20 Claims, 6 Drawing Sheets

DEVICES, SYSTEMS AND METHODS TO CALCULATE SLIDE STABILITY

TECHNICAL FIELD

The present disclosure is directed to systems, devices, and methods for measuring parameters of a slide drilling operation and determining performance of the operation. In particular, the present disclosure includes calculating a slide stability score or a measure of toolface angle consistency for a slide drilling operation.

BACKGROUND OF THE DISCLOSURE

At the outset of a drilling operation, drillers typically establish a drill plan that includes a steering objective location (or target location) and a drilling path to the steering objective location. Once drilling commences, the bottom hole assembly (BHA) may be directed or "steered" from a vertical drilling path in any number of directions, to follow the proposed drill plan. For example, to recover an underground hydrocarbon deposit, a drill plan might include a vertical bore to the side of a reservoir containing a deposit, then a directional or horizontal bore that penetrates the deposit. The operator may then follow the plan by steering the BHA through the vertical and horizontal aspects in accordance with the plan.

In slide drilling implementations, such directional drilling requires accurate orientation of a bent housing of the down hole motor. The bent housing is set on surface to a predetermined angle of bend. The high side of this bend is referred to as the toolface of the BHA. In such slide drilling implementations, rotating the drill string changes the orientation of the bent housing and the BHA, and thus the toolface. To effectively steer the assembly, the operator must first determine the current toolface orientation, such as via measurement-while-drilling (MWD) apparatus, and then compare it to a desired orientation. Thereafter, if the current drilling direction needs adjustment, the operator must rotate the drill string or alter other surface drilling parameters to change the toolface orientation.

In addition, uncertainties in drilling operations often occur which can lead to variation between the desired orientation and the actual desired orientation. For example, changes in drilling orientation may occur because of uncertainties in downhole lithology, dynamic wear on downhole motor and bit, and varying parameters of weight on bit and pressure drop across the drilling motor. These factors may make it challenging for an operator to assess the effectiveness of a slide when steering to create a curve in the wellbore. Furthermore, current drilling systems do not include a measurement or reporting of the consistency of toolface angle during a slide drilling operation. Since slide drilling is generally more expensive than rotary drilling because of the additional time required, efficiency measures to reduce sliding length and errors would result in cost savings for the drilling operation. Therefore, a more efficient, reliable, and intuitive method for calculating slide stability and reporting this to an operator is needed.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
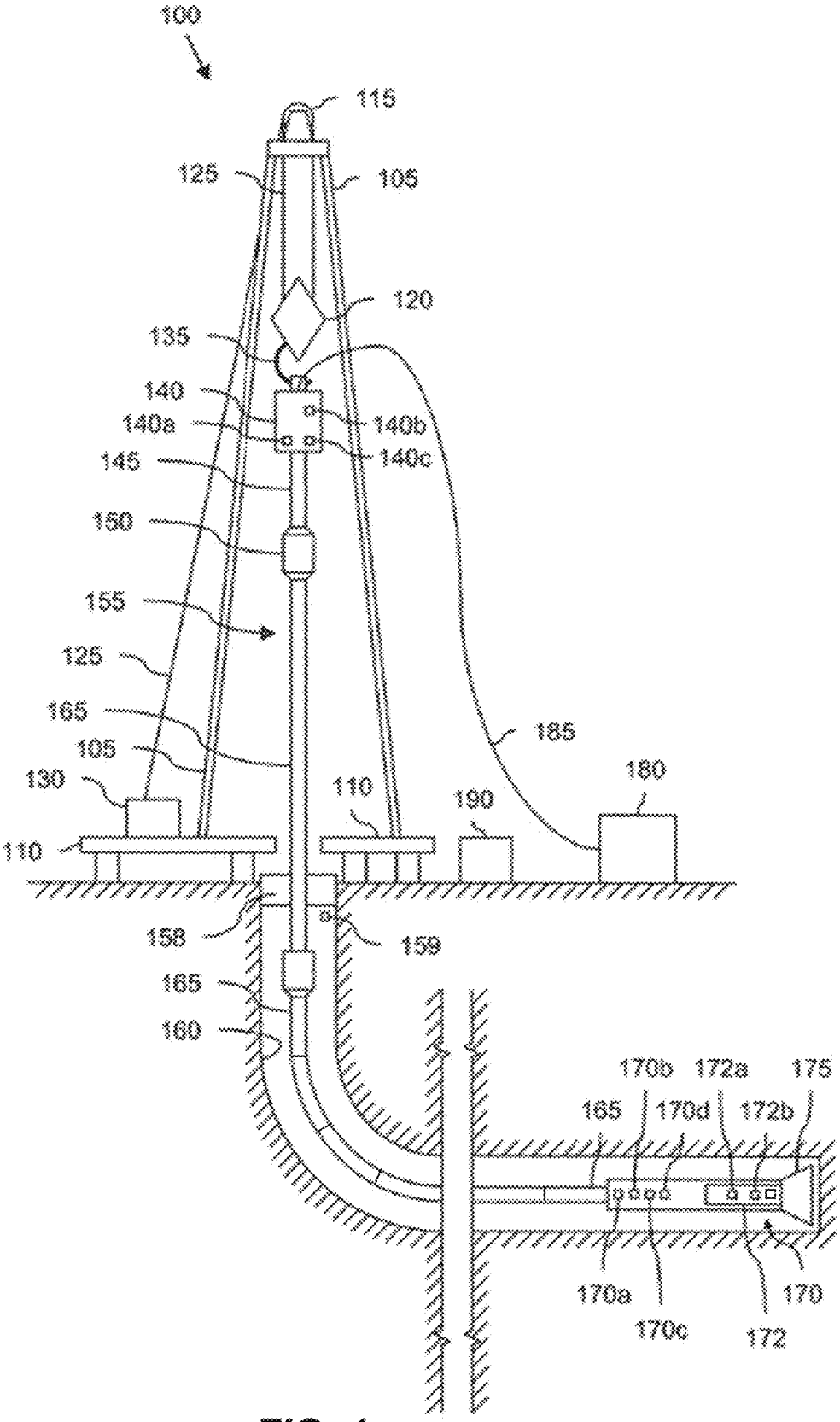
FIG. 1 is a schematic of an exemplary drilling apparatus according to one or more aspects of the present disclosure.

It is to be understood that the following disclosure describes many different implementations, or examples, for implementing different features of various implementations. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various implementations and/or configurations discussed.

This disclosure introduces systems and methods to measure toolface angles and assess the performance of a slide drilling operation, such as by measuring average toolface angle and calculating a slide stability score. In some implementations, the slide stability score is a representation of the consistency of toolface angle or toolface stability during a portion of the drilling operation, and may be expressed as a percentage. The slide stability score may help an operator to assess the efficiency of a slide drilling operation as well as to determine the ability of the drilling system to create a curved wellbore in a slide drilling operation. Furthermore, the calculation and application of the slide stability score may help reduce the amount of sliding required during a drilling operation, which would improve the economics of drilling the well (i.e., saving time and equipment wear by reducing tortuosity of the wellbore) and as well as the long-term economics of the completed well (i.e., increasing pumping production from the well by reducing unnecessary curvature from slide drilling).

Referring to FIG. 1, illustrated is a schematic view of apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

Apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to drawworks 130, which is configured to reel in and out the drilling line 125 to cause the traveling block 120 to be lowered and raised relative to the rig floor 110. The other end of the drilling line 125, known as a dead line anchor, is anchored to a fixed position, possibly near the drawworks 130 or elsewhere on the rig.

A hook 135 is attached to the bottom of the traveling block 120. A top drive 140 is suspended from the hook 135. A quill 145 extending from the top drive 140 is attached to a saver sub 150, which is attached to a drill string 155 suspended within a wellbore 160. Alternatively, the quill 145 may be attached to the drill string 155 directly. The term "quill" as used herein is not limited to a component which directly extends from the top drive, or which is otherwise conventionally referred to as a quill. For example, within the scope of the present disclosure, the "quill" may additionally or alternatively include a main shaft, a drive shaft, an output shaft, and/or another component which transfers torque, position, and/or rotation from the top drive or other rotary driving element to the drill string, at least indirectly. Nonetheless, albeit merely for the sake of clarity and conciseness, these components may be collectively referred to herein as the "quill."

The drill string 155 includes interconnected sections of drill pipe 165, a bottom hole assembly (BHA) 170, and a drill bit 175. The BHA 170 may include stabilizers, drill collars, and/or measurement-while-drilling (MWD) or wireline conveyed instruments, among other components. In some implementations, the BHA 170 includes a bent housing drilling system.

Implementations using bent housing drilling systems may require slide drilling techniques to execute or effect a turn using directional drilling. For the purpose of slide drilling, the bent housing drilling systems may include a down hole motor with a bent housing or other bend component operable to create an off-center departure of the bit from the center line of the wellbore. The direction of this departure from the centerline in a plane normal to the centerline is referred to as the "toolface angle." The drill bit 175, which may also be referred to herein as a "tool," may have a "toolface," connected to the bottom of the BHA 170 or otherwise attached to the drill string 155. One or more pumps 180 may deliver drilling fluid to the drill string 155 through a hose or other conduit 185, which may be connected to the top drive 140.

The down hole MWD or wireline conveyed instruments may be configured for the evaluation of physical properties such as pressure, temperature, torque, weight-on-bit (WOB), vibration, inclination, azimuth, toolface orientation in three-dimensional space, and/or other down hole parameters. These measurements may be made down hole, stored in memory, such as solid-state memory, for some period of time, and downloaded from the instrument(s) when at the surface and/or transmitted in real-time to the surface. Data transmission methods may include, for example, digitally encoding data and transmitting the encoded data to the surface, possibly as pressure pulses in the drilling fluid or mud system, acoustic transmission through the drill string 155, electronic transmission through a wireline or wired pipe, transmission as electromagnetic pulses, among other methods. The MWD sensors or detectors and/or other portions of the BHA 170 may have the ability to store measurements for later retrieval via wireline and/or when the BHA 170 is tripped out of the wellbore 160.

In an exemplary implementation, the apparatus 100 may also include a rotating blow-out preventer (BOP) 158 that may assist when the well 160 is being drilled utilizing under-balanced or managed-pressure drilling methods. The apparatus 100 may also include a surface casing annular pressure sensor 159 configured to detect the pressure in an annulus defined between, for example, the wellbore 160 (or casing therein) and the drill string 155.

In the exemplary implementation depicted in FIG. 1, the top drive 140 is utilized to impart rotary motion to the drill string 155. However, aspects of the present disclosure are also applicable or readily adaptable to implementations utilizing other drive systems, such as a power swivel, a rotary table, a coiled tubing unit, a down hole motor, and/or a conventional rotary rig, among others.

The apparatus 100 also includes a controller 190 configured to control or assist in the control of one or more components of the apparatus 100. For example, the controller 190 may be configured to transmit operational control signals to the drawworks 130, the top drive 140, the BHA 170 and/or the pump 180. The controller 190 may be a stand-alone component installed near the mast 105 and/or other components of the apparatus 100. In an exemplary implementation, the controller 190 includes one or more systems located in a control room in communication with the apparatus 100, such as the general purpose shelter often referred to as the "doghouse" serving as a combination tool shed, office, communications center, and general meeting place. The controller 190 may be configured to transmit the operational control signals to the drawworks 130, the top drive 140, the BHA 170, and/or the pump 180 via wired or wireless transmission devices which, for the sake of clarity, are not depicted in FIG. 1.

The controller 190 is also configured to receive electronic signals via wired or wireless transmission devices (also not shown in FIG. 1) from a variety of sensors included in the apparatus 100, where each sensor is configured to detect an operational characteristic or parameter. Depending on the implementation, the apparatus 100 may include a down hole annular pressure sensor **170*a* coupled to or otherwise associated with the BHA 170. The down hole annular pressure sensor 170*a* may be configured to detect a pressure value or range in an annulus shaped region defined between the external surface of the BHA 170 and the internal diameter of the wellbore 160, which may also be referred to as the casing pressure, down hole casing pressure, MWD casing pressure, or down hole annular pressure. Measurements from the down hole annular pressure sensor 170*a*** may include both static annular pressure (pumps off) and active annular pressure (pumps on).

It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data.

The apparatus 100 may additionally or alternatively include a shock/vibration sensor **170*b* that is configured to detect shock and/or vibration in the BHA 170. The apparatus 100 may additionally or alternatively include a mud motor pressure sensor 172*a* that is configured to detect a pressure differential value or range across one or more motors 172 of the BHA 170. The one or more motors 172 may each be or include a positive displacement drilling motor that uses hydraulic power of the drilling fluid to drive the drill bit 175, also known as a mud motor. One or more torque sensors 172*b* may also be included in the BHA 170 for sending data to the controller 190 that is indicative of the torque applied to the drill bit 175 by the one or more motors 172**.

The apparatus 100 may additionally or alternatively include a toolface sensor 170*c* configured to detect the current toolface orientation. The toolface sensor 170*c* may be or include a conventional or future-developed magnetic toolface sensor which detects toolface orientation relative to magnetic north. Alternatively, or additionally, the toolface sensor 170*c* may be or include a conventional or future-developed gravity toolface sensor which detects toolface orientation relative to the Earth's gravitational field. The toolface sensor 170*c* may also, or alternatively, be or include a conventional or future-developed gyro sensor. The apparatus 100 may additionally or alternatively include a WOB sensor 170*d* integral to the BHA 170 and configured to detect WOB at or near the BHA 170.

The apparatus 100 may additionally or alternatively include a torque sensor 140*a* coupled to or otherwise associated with the top drive 140. The torque sensor 140*a* may alternatively be located in or associated with the BHA 170. The torque sensor 140*a* may be configured to detect a value or range of the torsion of the quill 145 and/or the drill string 155 (e.g., in response to operational forces acting on the drill string). The top drive 140 may additionally or alternatively include or otherwise be associated with a speed sensor 140*b* configured to detect a value or range of the rotary speed of the quill 145.

The top drive 140, drawworks 130, crown or traveling block, drilling line or dead line anchor may additionally or alternatively include or otherwise be associated with a WOB sensor 140*c* (WOB calculated from a hook load sensor that can be based on active and static hook load, e.g., one or more sensors installed somewhere in the load path mechanisms to detect and calculate WOB, which can vary from rig to rig) different from the WOB sensor 170*d*. The WOB sensor 140*c* may be configured to detect a WOB value or range, where such detection may be performed at the top drive 140, drawworks 130, or other component of the apparatus 100.

The detection performed by the sensors described herein may be performed once, continuously, periodically, and/or at random intervals. The detection may be manually triggered by an operator or other person accessing a human-machine interface (HMI), or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection elements may include one or more interfaces which may be local at the well/rig site or located at another, remote location with a network link to the system.

Figure 2:
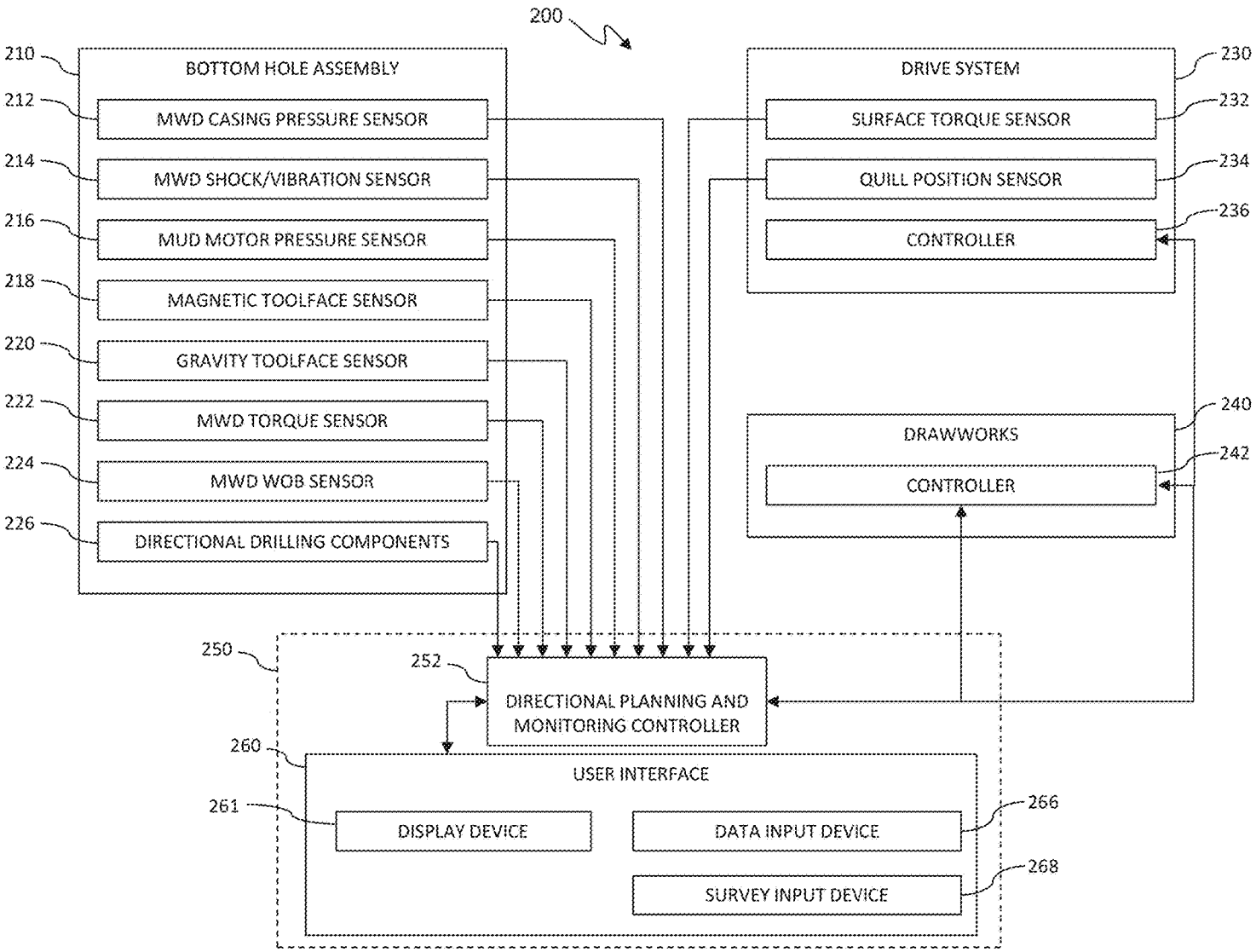
FIG. 2 is a schematic of an exemplary sensor and control system according to one or more aspects of the present disclosure.

Referring to FIG. 2, illustrated is a block diagram of an apparatus 200 according to one or more aspects of the present disclosure. The apparatus 200 includes a user interface 260, a bottom hole assembly (BHA) 210, a drive system 230, a drawworks 240, and a directional planning and monitoring controller 252. The apparatus 200 may be implemented within the environment and/or apparatus shown in FIG. 1. For example, the BHA 210 may be substantially similar to or may be the BHA 170 shown in FIG. 1, the drive system 230 may be substantially similar to the top drive 140 shown in FIG. 1, the drawworks 240 may be substantially similar to the drawworks 130 shown in FIG. 1, and the directional planning and monitoring controller 252 may be substantially similar to the controller 190 shown in FIG. 1.

The user interface 260 and the directional planning and monitoring controller 252 may be discrete components that are interconnected via wired or wireless devices. Alternatively, the user interface 260 and the directional planning and monitoring controller 252 may be integral components of a single system or controller 250, as indicated by the dashed lines in FIG. 2.

The user interface 260 may include a data input device 266 that permits a user to input one or more toolface set points. This may also include inputting other set points, limits, and other input data. The data input device 266 may include a keypad, voice-recognition apparatus, dial, button, switch, slide selector, toggle, joystick, mouse, data base and/or other conventional or future-developed data input device. Such data input device 266 may support data input from local and/or remote locations. Alternatively, or additionally, the data input device 266 may include one or more devices for providing a user selection of predetermined toolface set point values or ranges, such as via one or more drop-down menus or allows a user to enter desired setpoint values or ranges. The toolface set point data may also or alternatively be selected by the directional planning and monitoring controller 252 via the execution of one or more database look-up procedures. In general, the data input device 266 and/or other components within the scope of the present disclosure support operation and/or monitoring from stations on the rig site as well as one or more remote locations with a communications link to the system, network, local area network (LAN), wide area network (WAN), Internet, satellite-link, and/or radio, among other communication types.

The user interface 260 may also include a survey input device 268. The survey input device 268 may include information gathered from sensors regarding the orientation and location of the BHA 210. In some implementations, survey input device 268 is automatically entered into the user interface at regular intervals.

The user interface 260 may also include a display device 261 arranged to present visualizations of a down hole environment, such as a two-dimensional visualization and/or a three-dimensional visualization. The display device 261 may be used for visually presenting information to the user in textual, graphic, or video form. Depending on the implementation, the display device 261 may include, for example, an LED or LCD display computer monitor, touchscreen display, television display, a projector, or other display device. Some examples of information that may be shown on the display device 261 will be discussed in further detail with reference to FIG. 3.

The BHA 210 may include a MWD casing pressure sensor 212 that is configured to detect an annular pressure value or range at or near the MWD portion of the BHA 210, and that may be substantially similar to the down hole annular pressure sensor 170*a* shown in FIG. 1. The casing pressure data detected via the MWD casing pressure sensor 212 may be sent via electronic signal to the directional planning and monitoring controller 252 via wired or wireless transmission.

The BHA 210 may also include an MWD shock/vibration sensor 214 that is configured to detect shock and/or vibration in the MWD portion of the BHA 210, and that may be substantially similar to the shock/vibration sensor 170*b* shown in FIG. 1. The shock/vibration data detected via the MWD shock/vibration sensor 214 may be sent via electronic signal to the directional planning and monitoring controller 252 via wired or wireless transmission.

The BHA 210 may also include a mud motor pressure sensor 216 that is configured to detect a pressure differential value or range across the mud motor of the BHA 210, and that may be substantially similar to the mud motor pressure sensor 172*a* shown in FIG. 1. The pressure differential data detected via the mud motor pressure sensor 216 may be sent via electronic signal to the directional planning and monitoring controller 252 via wired or wireless transmission. The mud motor pressure may be alternatively or additionally calculated, detected, or otherwise determined at the surface, such as by calculating the difference between the surface standpipe pressure just off-bottom and pressure once the bit touches bottom and starts drilling and experiencing torque.

The BHA 210 may also include a magnetic toolface sensor 218 and a gravity toolface sensor 220 that are cooperatively configured to detect the current toolface, and that collectively may be substantially similar to the toolface sensor 170*c* shown in FIG. 1. The magnetic toolface sensor 218 may be or include a conventional or future-developed magnetic toolface sensor which detects toolface orientation relative to magnetic north. The gravity toolface sensor 220 may be or include a conventional or future-developed gravity toolface sensor which detects toolface orientation relative to the Earth's gravitational field. In an exemplary implementation, the magnetic toolface sensor 218 may detect the current toolface when the end of the wellbore is less than about 7° from vertical, and the gravity toolface sensor 220 may detect the current toolface when the end of the wellbore is greater than about 7° from vertical. However, other toolface sensors may also be utilized within the scope of the present disclosure, including non-magnetic toolface sensors and non-gravitational inclination sensors. In any case, the toolface orientation detected via the one or more toolface sensors (e.g., magnetic toolface sensor 218 and/or gravity toolface sensor 220) may be sent via electronic signal to the directional planning and monitoring controller 252 via wired or wireless transmission.

The BHA 210 may also include an MWD torque sensor 222 that is configured to detect a value or range of values for torque applied to the bit by the motor(s) of the BHA 210, and that may be substantially similar to the torque sensor 172*b* shown in FIG. 1. The torque data detected via the MWD torque sensor 222 may be sent via electronic signal to the directional planning and monitoring controller 252 via wired or wireless transmission.

The BHA 210 may also include a MWD WOB sensor 224 that is configured to detect a value or range of values for WOB at or near the BHA 210, and that may be substantially similar to the WOB sensor 170*d* shown in FIG. 1. The WOB data detected via the MWD WOB sensor 224 may be sent via electronic signal to the directional planning and monitoring controller 252 via wired or wireless transmission.

Depending upon the implementation, the BHA 210 may include one or more directional drilling components 226. These components may include bent housing system components. In some implementations, the directional drilling components 226 may include a drilling motor that forms part of the BHA 210.

The drawworks 240 may include a controller 242 and/or other devices for controlling feed-out and/or feed-in of a drilling line (such as the drilling line 125 shown in FIG. 1). Such control may include rotary control of the drawworks (in versus out) to control the height or position of the hook, and may also include control of the rate the hook ascends or descends.

The drive system 230 may form the top drive 140 and may include a surface torque sensor 232 that is configured to detect a value or range of the reactive torsion of the quill or drill string, much the same as the torque sensor 140*a* shown in FIG. 1. The drive system 230 also includes a quill position sensor 234 that is configured to detect a value or range of the rotary position of the quill, such as relative to true north or another stationary reference. The surface torsion and quill position data detected via the surface torque sensor 232 and the quill position sensor 234, respectively, may be sent via electronic signal to the directional planning and monitoring controller 252 via wired or wireless transmission. The drive system 230 also includes a controller 236 and/or other devices for controlling the rotary position, speed and direction of the quill or other drill string component coupled to the drive system 230 (such as the quill 145 shown in FIG. 1).

The directional planning and monitoring controller 252 may be configured to receive one or more of the above-described parameters from the user interface 260, the BHA 210, the drawworks 240, and/or the drive system 230, and utilize such parameters to continuously, periodically, or otherwise determine the current toolface orientation. The directional planning and monitoring controller 252 may be further configured to generate a control signal, such as via intelligent adaptive control, and provide the control signal to the drive system 230 and/or the drawworks 240 to adjust and/or maintain the toolface orientation. For example, the directional planning and monitoring controller 252 may provide one or more signals to the drive system 230 and/or the drawworks 240 to increase or decrease WOB and/or quill position, such as may be required to accurately "steer" the drilling operation. The directional planning and monitoring controller 252 may also be configured to provide signals to the RSS components to change the RSS drilling control parameters.

Figure 3:
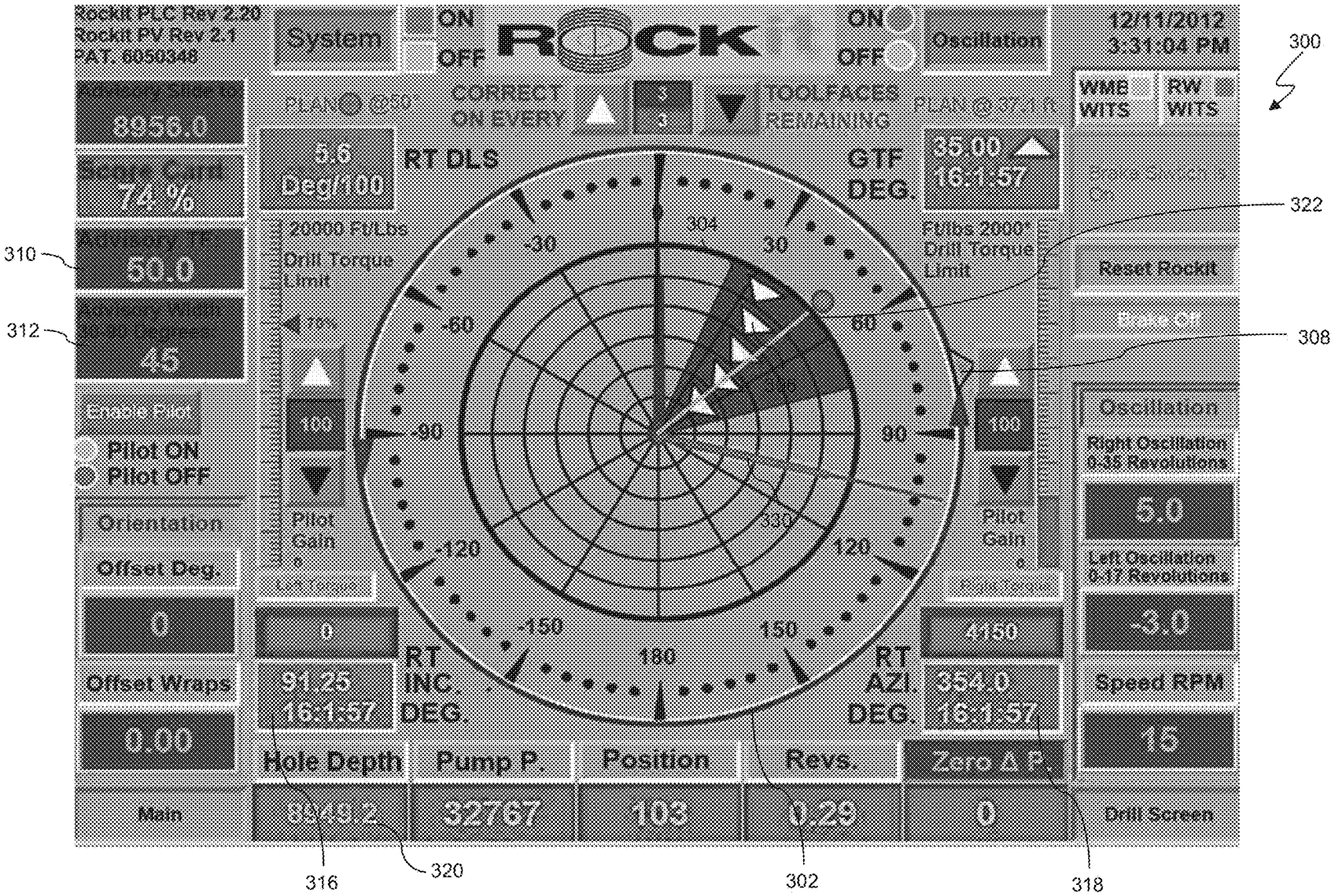
FIG. 3 is a schematic of an exemplary display apparatus showing a two-dimensional visualization.

FIG. 3 shows a schematic view of a human-machine interface (HMI) 300 according to one or more aspects of the present disclosure. The HMI 300 may be utilized by a human operator during directional and/or other drilling operations to monitor the relationship between toolface orientation and quill position. The HMI 300 may include aspects of the ROCKit® HMI display of Canrig Drilling Technology, LTD. In an exemplary implementation, the HMI 300 is one of several display screens selectably viewable by the user during drilling operations, and may be included as or within the human-machine interfaces, drilling operations and/or drilling apparatus described in the systems herein. The HMI 300 may also be implemented as a series of instructions recorded on a computer-readable medium, such as described in one or more of these references. In some implementations, the HMI 300 is the two-dimensional visualization 262 of FIG. 2.

The HMI 300 is used by a user, who may be a directional driller operator, while drilling to monitor the status and direction of drilling using the BHA. The directional planning and monitoring controller 252 of FIG. 2 may drive one or more other human-machine interfaces during drilling operation and may be configured to also display the HMI 300 on the display device 261. The directional planning and monitoring controller 252 driving the HMI 300 may include a "survey" or other data channel, or otherwise includes devices for receiving and/or reading sensor data relayed from the BHA 170, a measurement-while-drilling (MWD) assembly, a RSS assembly, and/or other drilling parameter measurement devices, where such relay may be via the Wellsite Information Transfer Standard (WITS), WITS Markup Language (WITS ML), and/or another data transfer protocol. Such electronic data may include gravity-based toolface orientation data, magnetic-based toolface orientation data, azimuth toolface orientation data, and/or inclination toolface orientation data, among others.

As shown in FIG. 3, the HMI 300 may be depicted as substantially resembling a dial or target shape 302 having a plurality of concentric nested rings. The HMI 300 also includes a pointer 330 representing the quill position. Symbols for magnetic toolface data and gravity toolface data symbols may also be shown. In the example of FIG. 3, gravity toolface angles are depicted as toolface symbols 306. In one exemplary implementation, the symbols for the magnetic toolface data are shown as circles and the symbols for the gravity toolface data are shown as rectangles. Of course, other shapes may be utilized within the scope of the present disclosure. The toolface symbols 306 may also or alternatively be distinguished from one another via color, size, flashing, flashing rate, and/or other graphic elements.

In some implementations, the toolface symbols 306 may indicate only the most recent toolface measurements. However, as in the exemplary implementation shown in FIG. 3, the HMI 300 may include a historical representation of the toolface measurements, such that the most recent measurement and a plurality of immediately prior measurements are displayed. Thus, for example, each ring in the HMI 300 may represent a measurement iteration or count, or a predetermined time interval, or otherwise indicate the historical relation between the most recent measurement(s) and prior measurement(s). In the exemplary implementation shown in FIG. 3, there are five such rings in the dial 302 (the outermost ring being reserved for other data indicia), with each ring representing a data measurement or relay iteration or count. The toolface symbols 306 may each include a number indicating the relative age of each measurement. In the present example, the outermost triangle of the toolface symbols 306 corresponds to the most recent measurement. After the most recent measurement, previous measurements are positioned incrementally towards the center of the dial 302. In other implementations, color, shape, and/or other indicia may graphically depict the relative age of measurement. Although not depicted as such in FIG. 3, this concept may also be employed to historically depict the quill position data. In some implementations, measurements are taken every 10 seconds, although depending on the implementation, measurements may be taken at time periods ranging from every second to every half-hour. Other time periods are also contemplated.

The HMI 300 may also include a number of textual and/or other types of indicators 316, 318, 320 displaying parameters of the current or most recent toolface orientation. For example, indicator 316 shows the inclination of the wellbore, measured by the survey instrument, as 91.25°. Indicator 318 shows the azimuth of the wellbore, measured by the survey instrument as 354°. Indicator 320 shows the hole depth of the wellbore as 8949.2 feet. In the exemplary implementation shown, the HMI 300 may include a programmable advisory width. In the example of FIG. 3, this value is depicted by advisory width sector 304 with an adjustable angular width corresponding to an angular setting shown in the corresponding indicator 312, in this case 45°. The advisory width is a visual indicator providing the user with a range of acceptable deviation from the advisory toolface direction. In the example of FIG. 3, the toolface symbols 306 all lie within the advisory width sector 304, meaning that the user is operating within acceptable deviation limits from the advisory toolface direction. Indicator 310 gives an advisory toolface direction, corresponding to line 322. The advisory toolface direction represents an optimal direction towards the drill plan. Indicator 308, shown in FIG. 3 as an arrow on the outermost edge of the dial 302, is an indicator of the overall resultant direction of travel of the toolface. This indicator 308 may present an orientation that averages the values of other indicators 316, 318, 320. Other values and depictions are included on the HMI 300 that are not discussed herein. These other values include the time and date of drilling, aspects relating to the operation of the drill, and other received sensor data.

Figure 4B:
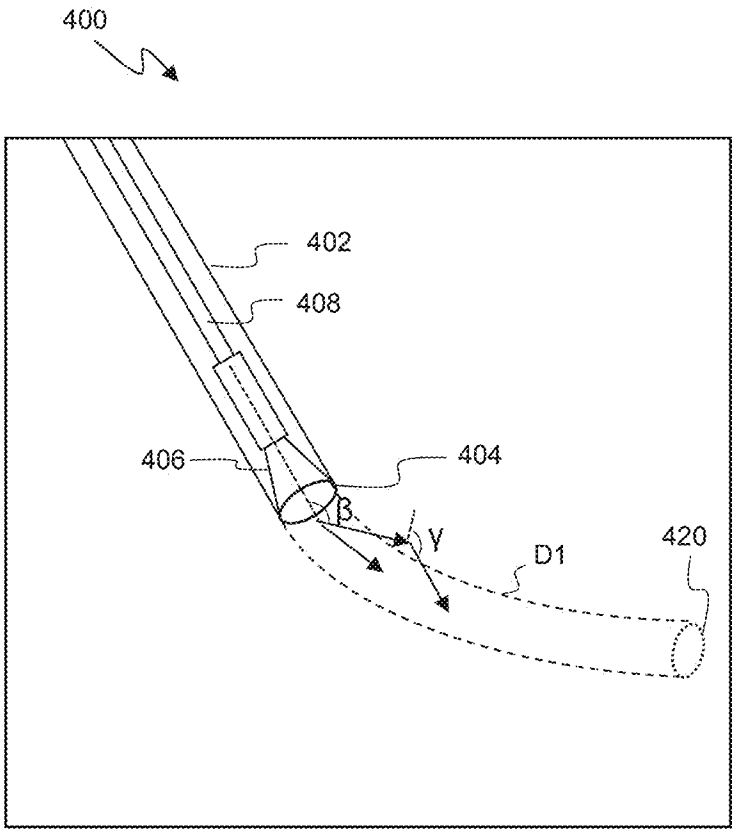
FIG. 4B is another representation of a down hole environment including a wellbore according to one or more aspects of the present disclosure.
Figure 4A:
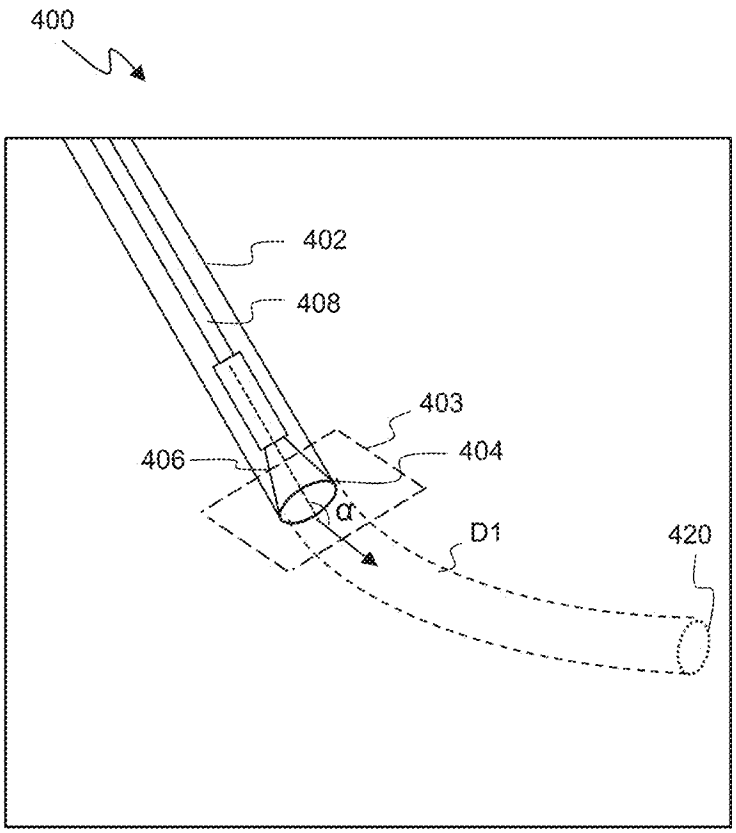
FIG. 4A is a representation of a down hole environment including a wellbore according to one or more aspects of the present disclosure.

FIGS. 4A and 4B show exemplary representations of a down hole environment 400 including a down hole portion of a drilling system including a BHA 406 and drill string 408. In some implementations, instructions to drive the BHA 406 to various drilling targets or steering objective locations in the down hole environment 400 may be implemented to drive the BHA 406 through the down hole environment 400. The drill string 408 may be made up of a number of tubulars. The BHA 406 and drill string 408 correspond to the BHA 170 and drill string 155 in FIG. 1, and may form a portion of the drilling apparatus 100 described with reference to FIGS. 1 and 2. FIGS. 4A and 4B show the BHA 406 and drill string 408 within a drilled bore, with an end of the drilled bore designated by the reference number 404, also referred to as a bore end 404. The bore end 404 may represent the bottom of a wellbore 402 drilled by the BHA 406. In some implementations, the bore end 404 corresponds to the location of the BHA 406, and the location of the bore end 404 may be determined by determining the location of the BHA 406. In some implementations, a toolface direction or angle may be measured relative to a plane 403 normal to a longitudinal axis of the BHA 406. In the example of FIG. 4A, the toolface direction or angle is illustrated by angle $\alpha$. As a slide is effected, the BHA 406 is driven along a distance D1 (i.e., well path) to a new bore end 420. In some implementations, the toolface angle is chose as a constant value for a portion of the drilling operation (i.e., angle $\alpha$ remains constant along distance D1). The toolface angle may be measured continuously or at intervals during the drilling operation. For example, the toolface angle may be measured, for example, every 15-20 seconds. In other implementations, the toolface angle is measured every 1-5 sections, every 5-10 seconds, or every 20-30 seconds. Other ranges, more frequent and less frequent are also contemplated. The toolface angle may be transmitted to a controller on the drilling rig, such as the directional planning and monitoring controller 252 as shown in FIG. 1, and may be displayed on an HMI 300 as shown in FIGS. 3 and 5.

In some implementations, the toolface angle varies as the BHA 406 is driven during the drilling operation. For example, although angle $\alpha$ may be chosen as an initial toolface angle, the BHA 406 may be driven at angle $\beta$ instead in the example shown in in FIG. 4B. This may occur because of unexpected conditions downhole (such as differences in formations), wear on drilling components such as the downhole motor or drilling bit, or variation in drilling parameters such as weight on bit or pressure on the drill string. Furthermore, the toolface angle may change throughout a portion of a drilling operation. For example, the toolface angle changes to angle $\gamma$ during the drilling operation shown in FIG. 4B. These changes in toolface angle may cause inefficiencies in the drilling operation, such as deviation from a drilling plan (i.e., the resulting bore end 420 may not conform to a drilling plan in the example of FIG. 4B). Calculation of average toolface angle and calculation of slide stability may help an operator to more accurately assess and address these problems, as discussed in reference to FIGS. 5 and 6.

Figure 5:
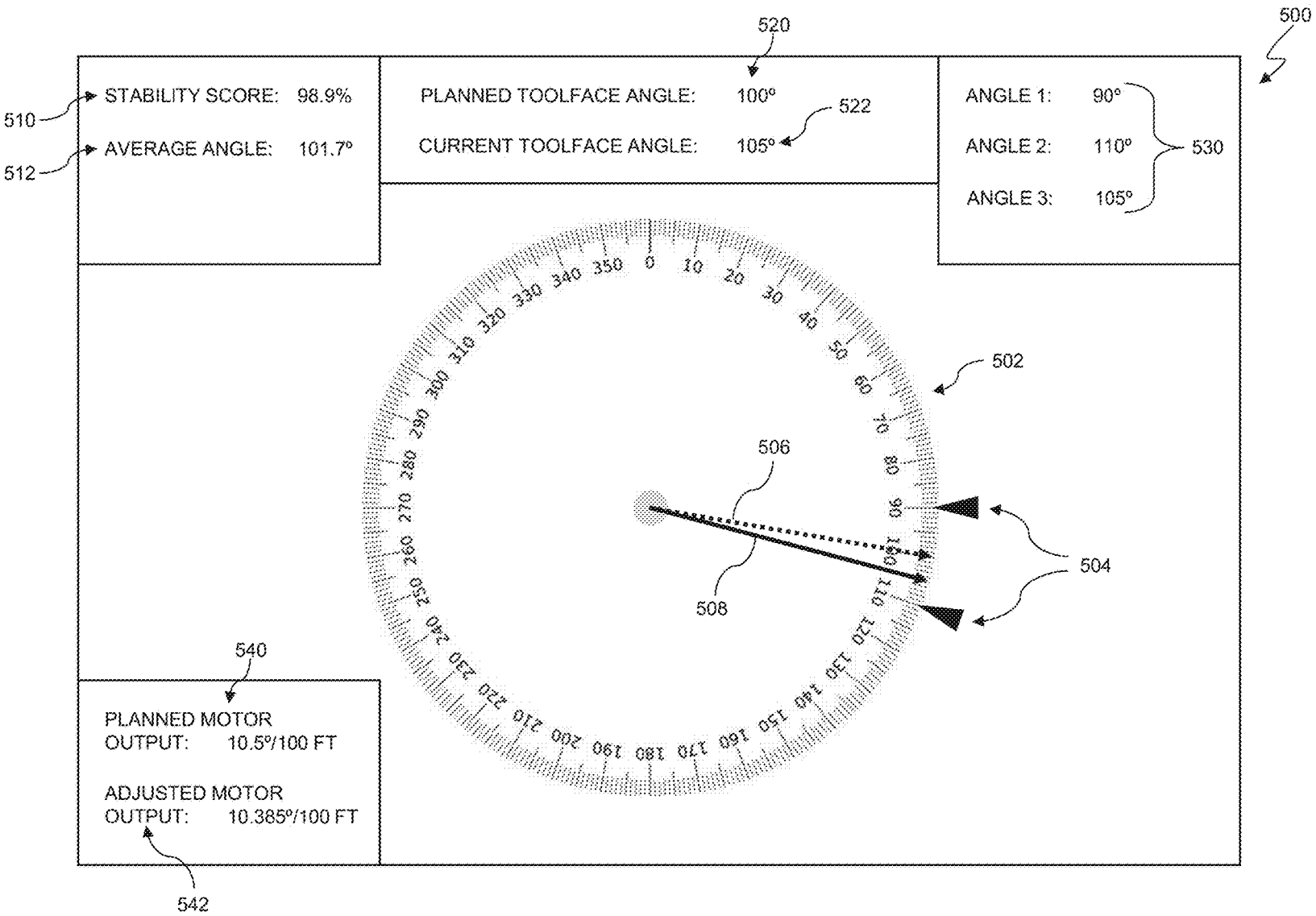
FIG. 5 is a representation of an exemplary slide drilling display according to one or more aspects of the present disclosure.

FIG. 5 shows a schematic view of an interface 500 according to one or more aspects of the present disclosure. The interface 500 may be utilized by a human operator during directional and/or other drilling operations to monitor the direction and output of the toolface. The interface 500 may be updated automatically with data received during a drilling operation, such as with measured toolface angles. In some implementations, the values shown on the interface 500 are calculated automatically by a controller, such as controller 190 shown in FIG. 1 or the directional planning and monitoring controller 252 as shown in FIG. 2. The interface 500 may include a dial 502 including one or more unit vectors 506, 508 representing toolface angles. The dial 502 may also include previously measured toolface angles (shown by triangular symbols 504 at 90 degrees and 110 degrees, respectively). The dial 502 may be configured to show a difference between planned toolface angles 520 and current toolface angles 522. In the example of FIG. 5, the planned toolface angle 520 is 100 degrees and the current toolface angle 522 is 105 degrees, showing a deviation in toolface angle of 5 degrees. The toolface angles may be represented in other formats, such as in text format, on a scale, or by varying visual representations including different symbols, colors, patterns, and textures.

By considering each measured toolface angle as a unit vector 506, 508, the controller may be configured to calculate slide drilling parameters such as average toolface angle, stability score, and motor output which may be displayed on the interface 500. These parameters are not available on current drilling rigs. For example, calculations of average toolface using degree measurements in current drilling systems may be inaccurate. For instance, if four azimuth measurements are recorded at 355 degrees, 345 degrees, 5 degrees, and 10 degrees (all in a northerly direction) taking a standard average (i.e., adding the measurements together and dividing by four) will give an average of 173.75 degrees, which is inaccurate because it is in a southerly direction. This problem also occurs in determining stability or consistency of toolface angles. The parameters shown in the interface 500 may correct this problem by giving an accurate average toolface angle 512 as well as an accurate measurement of the consistency of toolface angles with the slide stability score 510.

The controller may automatically convert each measured toolface angle to a unit vector and calculate the slide stability score with the following formula:

$$S = \sqrt{\left(\frac{\sin(a) + \sin(b) + \ldots + \sin(z)}{n}\right)^2 + \left(\frac{\cos(a) + \cos(b) + \ldots + \cos(z)}{n}\right)^2}$$

where S is the slide stability score, a is a first measured toolface angle in degrees, b is a second measured toolface angle in degrees, z is an nth toolface angle in degrees, and n is the number of measured toolface angles for the drilling operation.

The system may automatically calculate the average toolface angle with the following formula:

$$A = a\tan2\left(\frac{\sin(a) + \sin(b) + \ldots + \sin(z)}{n}, \frac{\cos(a) + \cos(b) + \ldots + \cos(z)}{n}\right)$$

where A is the average toolface angle in degrees, a is a first measured toolface angle in degrees, b is a second measured toolface angle in degrees, z is an nth toolface angle in degrees, and n is the number of measured toolface angles for the drilling operation (adding 180 for negative values).

In the example of FIG. 5, the controller has received three measured toolface angles 530 during a drilling operation which are converted to unit vectors (i.e., drilling angle 1 of 90 degrees, drilling angle 2 of 110 degrees, and drilling angle 3 of 105 degrees). Other numbers of drilling angles may be measured during a drilling operation, such as every 15-20 seconds. The sine and cosine values for each unit vector are then calculated. In some implementations, the sine value of each unit vector may represent departure in an East-West direction (i.e., East being positive and West being negative), and the cosine value of each unit vector may represent departure in a North-South direction (i.e., North being positive and South being negative). The sine values of all toolface angles are all added together and divided by the total number of toolface angles. The cosine values are likewise added together and divided by the total number of toolface angles as well. In the example of FIG. 5, the following values would be calculated by the controller:

$$\frac{\sin(90) + \sin(110) + \sin(105)}{3} = 0.969$$

$$\frac{\cos(90) + \cos(110) + \cos(105)}{3} = -0.200$$

The above values represent the average East-West deviation and average North-South deviation of the measured toolface angles, respectively. To calculate the average toolface angle, the controller may take the inverse tangent of the averaged sine and cosine values:

$$\text{atan } 2(-0.200, 0.969) = 101.7 \text{ degrees.}$$

The calculated average toolface angle 512 may be displayed on the interface 500 as shown in FIG. 5.

The slide stability score may also be calculated by taking the square root of the product of the averaged sine and cosine values, squared, as shown below:

$$S = \sqrt{(0.969)^2 + (-0.200)^2} = 0.989.$$

Since the calculated slide stability score S will always be between 0 and 1 (i.e., all angles are measured between 0 and 360 degrees), multiplying the above result by 100 gives a slide stability score 510 as a percentage (S=98.9%). The calculated slide stability score 510 may be automatically calculated based on the received toolface angles and displayed on the interface 500, as shown in FIG. 5. The slide stability score 510 may be used to assess the performance of drilling equipment as well as assess the theoretical curvature of a directional motor such that the length of sliding in subsequent drilling operations may be more accurately calculated.

Values for planned motor output 540 and adjusted motor output 542 may also be displayed on the interface 500. In some implementations, the planned motor output is the ability of the drilling equipment to produce curvature in the well bore under stable conditions. The planned motor output may be measured in units of degrees per distance. In the example of FIG. 5, the planned motor output is 10.5 degrees per hundred feet, meaning that under ideal conditions, the drilling rig is able to produce a maximum curvature of 10.5 degrees per 100 feet of wellbore. The slide stability score 510, as calculated above, may be used to estimate the actual (i.e., adjusted) motor output 542. In this case, the planned motor output 540 is multiplied by the slide stability score 510 to calculate the adjusted motor output 542:

0.989*(10.5 degrees/100 feet)=10.385 degrees/100 feet.

The adjusted motor output 542 may be displayed on the interface 500 as shown. The adjusted motor output 542 may be used by an operator to adjust drill plans and avoid drilling errors.

Figure 6:
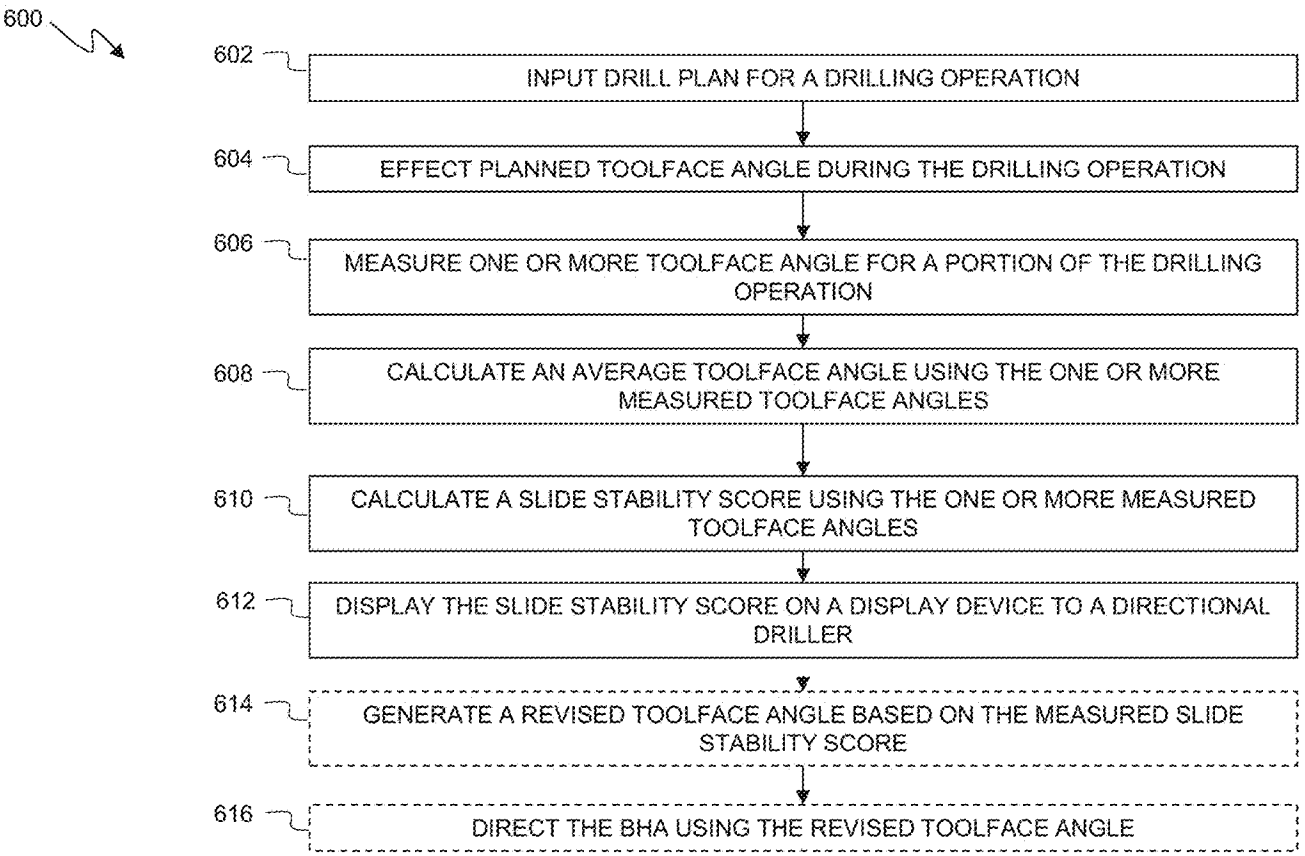
FIG. 6 is a flowchart diagram of a method of directing operation of a drilling system according to one or more aspects of the present disclosure.

FIG. 6 is a flow chart showing a method 600 of measuring toolface angles, calculating a slide steering stability score, and steering a BHA. It is understood that additional steps can be provided before, during, and after the steps of method 600, and that some of the steps described can be replaced or eliminated for other implementations of the method 600. In particular, any of the control systems disclosed herein, including those of FIGS. 1 and 2, and the displays of FIGS. 3 and 5, may be used to carry out the method 600.

At step 602, the method 600 may include inputting a drill plan for a drilling operation. This may be accomplished by entering location and orientation coordinates into a controller of a drilling system such as the directional planning and monitoring controller 252 discussed with reference to FIG. 2. The drill plan may also be entered via the user interface, and/or downloaded or transferred to directional planning and monitoring controller 252. The directional planning and monitoring controller 252 may therefore receive the drill plan directly from the user interface or a network or disk transfer or from some other location. In some implementations, the drill plan includes one or more slide drilling operations with at least one planned toolface angle. For example, the interface 500 of FIG. 5 includes a planned toolface angle of 100 degrees for a portion of a slide drilling operation. The drill plan may include effecting a number of planned toolface angles for various portions of a drill operation. For example, a drill plan may include drilling down 1000 feet, effecting a 5 degree toolface angle, sliding for 100 feet, then effecting a 10 degree toolface angle and sliding for 200 feet.

At step 604, the method 600 may include effecting a planned toolface angle during the drilling operation. This may include adjusting the drill string using the top drive to rotate the bent motor of the BHA of the directional drilling system to the planned toolface angle. When the actual toolface angle corresponds to the planned toolface angle, then the driller may begin the sliding operation.

At step 606, the method 600 may include measuring a toolface angle for one or more segments of the sliding operation. Some drill plans include curves that are followed by the BHA by dividing the curve into segments. The toolface angle may be measured with respect to a plane normal to the longitudinal axis of the BHA. In some implementations, the toolface angle is measured with one or more sensors on the drilling rig, such as along the drill string or on the BHA. For example, a combination of controllers, such as those in FIG. 2, may receive sensor data from a number of sensors via electronic communication. The controllers may then transmit the data to a central location for processing such as the directional planning and monitoring controller 252. The toolface angle measurement may be transmitted to a controller which may convert the angle to a unit vector. Other toolface angles may also be measured and transmitted during the drilling operation either continuously or at regular intervals. In some examples, the toolface angles may be measured and transmitted, for example only, every 15-20 seconds or every 10 feet of well bore. In some implementations, the toolface angle of the BHA is measured and transmitted in real time. The change in toolface angle may represent a deviation from the planned toolface angle and may occur because of unexpected formations, problems with drilling equipment, or varying parameters in the drilling equipment.

At step 608, the method 600 may include calculating an average toolface angle using the one or more measured toolface angles captured over time or distance. In some implementations, all measured toolface angles for a drilling operation may be received by the controller and stored in memory. To calculate the average toolface angle, the controller may automatically calculate the sum of the sine values of the toolface angles and the sum of the cosine values of the toolface angles and divide these values by the number of measured toolface angles. The controller may then take the inverse tangent of the averaged sine and cosine values. as discussed above in reference to FIG. 5, the average toolface angle may be calculated using the following example formula:

$$A = a\tan2\left(\frac{\sin(a)+\sin(b)+\ldots+\sin(z)}{n}, \frac{\cos(a)+\cos(b)+\ldots+\cos(z)}{n}\right)$$

where A is the average toolface angle in degrees, a is a first measured toolface angle in degrees, b is a second measured toolface angle in degrees, z is an nth drilling angle in degrees, and n is the number of measured toolface angles for the drilling operation (adding 180 for negative values). The average toolface angle may be automatically calculated by the controller and stored in a memory by the controller.

At step 610, the method 600 may include calculating a slide stability score based on the received toolface angles. The slide stability score may represent a consistency of the toolface angle or a stability of the toolface during a drilling operation. As discussed above, in one example, the slide stability score may be calculated using the following formula:

$$S = \sqrt{\left(\frac{\sin(a)+\sin(b)+\ldots+\sin(z)}{n}\right)^2 + \left(\frac{\cos(a)+\cos(b)+\ldots+\cos(z)}{n}\right)^2}$$

where S is the stability score, a is a first measured toolface angle in degrees, b is a second measured toolface angle in degrees, z is an nth toolface angle in degrees, and n is the number of measured toolface angles for the drilling operation. In some implementations, the slide stability score is given as a percentage between 0 and 100%. The slide stability score may be automatically calculated by the controller and stored in a memory by the controller.

At step 612, the method 600 may include displaying the slide stability score on a display to a directional driller. In some implementations, the slide stability score is displayed on a display device, such as on a computer monitor. The slide stability score may be displayed along with a textual or visual representation of the measured toolface angles, as shown in the exemplary interface 500 of FIG. 5. The display may also include the average toolface angle, planned motor output, adjusted motor output, and other measured parameters of the drilling operation. The operator may refer to the display during a drilling operation and use the slide stability measurement as a guide as the drilling operation progresses.

At step 614, the method 600 may optionally include generating a revised toolface angle based on the measured slide stability score. For example, the controller may receive the slide stability score and assess the ability of the drilling motor to create an accurate curve in the wellbore. The controller may then compare this curvature for the drilling operation as detailed by the drill plan. In this comparison, the controller may determine an amount of deviation between the drill plan and the curvature determined by the slide stability score. (e.g., the controller may recognize that an adjusted motor output is not sufficient to produce the curvature needed for an upcoming slide drilling operation). In this case, the controller may determine an adjustment needed to correct the deviation (i.e., an amount of curvature or distance) and align the wellbore with the drill plan. The controller may then output a revised toolface angle to execute this adjustment and display this revised toolface angle to the operator. Therefore, the controller may revise the toolface angle setting to more efficiently perform the slide drilling operation and output this revised toolface angle setting to the operator. In other example, the controller may receive a low slide stability score for a particular segment of the drilling rig (e.g., a large amount of variability in toolface angle due to a problematic formation). The controller may generate a revised toolface angle to improve the drilling operation in some way based on the slide stability score, such as cutting a slide drilling operation short to avoid further drilling through the problematic formation or sliding at a later time. As before, the controller may output this revised toolface angle to the operator.

At step 616, the method 600 may include directing the BHA using the revised toolface angle setting. For example, the operator may use the revised toolface angle setting as a guide for directing the BHA in one or more future slide drilling operations.

In an exemplary implementation within the scope of the present disclosure, the method 600 repeats after step 612, 614, or 616, such that method flow goes back to step 604 and begins again. Iteration of the method 600 may be performed during a drilling operation.

In view of all of the above and the figures, one of ordinary skill in the art will readily recognize that the present disclosure introduces a method of operating a drilling system, comprising; inputting a drill plan into a directional drilling system comprising a bottom hole assembly (BHA), the drill plan comprising a slide drilling operation; conducting the slide drilling operation, comprising: effecting an incident toolface angle of the BHA for a first distance of the slide drilling operation; measuring a first toolface angle during the slide drilling operation; comparing the measured first toolface angle to the incident toolface angle; calculating an amount of consistency of the toolface angle over the first distance of the slide drilling operation based on the comparison of the measured first toolface angle to the incident toolface angle; and displaying the amount of consistency of the toolface angle over the first distance of the slide drilling operation to an operator on a display device.

In some implementations, the method further includes calculating an average toolface angle of the BHA over the first distance of the slide drilling operation, and displaying the average toolface angle of the BHA over the first distance of the slide drilling operation to the operator on the display device. The method may include measuring a second toolface angle of the BHA over a second distance of the slide drilling operation; comparing the measured second toolface angle to the incident toolface angle; and calculating a second amount of consistency of the toolface angle over the second distance during the slide drilling operation based on the comparison of the measured second toolface angle to the incident toolface angle.

The second amount of consistency of the toolface angle may be given as:

$$S = \sqrt{\left(\frac{\sin(a) + \sin(b) + \ldots + \sin(z)}{n}\right)^2 + \left(\frac{\cos(a) + \cos(b) + \ldots + \cos(z)}{n}\right)^2}$$

where S is the second amount of consistency of the toolface angle, a is the measured first toolface angle of the BHA in degrees, b is the measured second toolface angle of the BHA in degrees, z is a measured nth toolface angle of the BHA in degrees, and n is a number of measured toolface angles for the drilling operation.

In some implementations, the method further includes determining an ideal maximum amount of curvature of a wellbore that the BHA is able to execute. The method may include calculating a modified maximum amount of curvature of the wellbore that the BHA is able to execute during the slide drilling operation using the calculated amount of consistency of the toolface angle. The method may include calculating the modified maximum amount of curvature in the wellbore by multiplying the amount of consistency of the toolface angle by the ideal maximum amount of curvature of the wellbore that the BHA is able to execute. The method may also include using the calculated amount of consistency of the toolface angle to automatically update the drill plan for the slide drilling operation.

A method of measuring data of a drilling operation is also provided, including: conducting a drilling operation with a directional drilling system comprising a drilling rig, one or more sensors, a controller, and a bottom hole assembly (BHA); measuring, with the one or more sensors, one or more toolface angles of the BHA during the drilling operation; calculating, with the controller, a slide stability score for the drilling operation based on the measured one or more toolface angles, the slide stability score representing an amount of consistency of the toolface angle during the drilling operation; and displaying the slide stability score to an operator on a display device.

In some implementations, the slide stability score is given as:

$$S = \sqrt{\left(\frac{\sin(a) + \ldots + \sin(z)}{n}\right)^2 + \left(\frac{\cos(a) + \ldots + \cos(z)}{n}\right)^2}$$

where S is the slide stability score, a is a first toolface angle in degrees, z is an nth toolface angle in degrees, and n is a number of measured toolface angles for the drilling operation.

The method may also include determining an initial motor yield representing an ideal maximum amount of curvature of a wellbore that the BHA is able to execute or calculating an adjusted motor yield representing the maximum amount of curvature of the wellbore that the BHA is able to execute during the drilling operation using the calculated slide stability score. The method may include calculating the adjusted motor yield by multiplying the slide stability score by the initial motor yield. The method may also include using the slide stability score to automatically update a drill plan for the drilling operation.

A drilling apparatus is also provided, comprising: a drill string comprising a plurality of tubulars; a bottom hole assembly (BHA) disposed at a distal end of the drill string; a sensor system connected to the BHA and configured to measure a toolface angle of the BHA; a controller in communication with the BHA and the sensor system, wherein the controller is configured to: determine one or more toolface angles of the BHA during a drilling operation; calculate a slide stability score for the drilling operation based on the measured one or more toolface angles, the slide stability score representing an amount of consistency of the toolface angle during the drilling operation; and a display device configured to display the slide stability score to a user.

In some implementations, the toolface angles are azimuth values between 0 and 360 degrees. The controller may be configured to update the slide stability score in real time based on the measured one or more toolface angles. In some implementations, the slide stability score is given as:

$$S = \sqrt{\left(\frac{\sin(a) + \ldots + \sin(z)}{n}\right)^2 + \left(\frac{\cos(a) + \ldots + \cos(z)}{n}\right)^2}$$

where S is the slide stability score, a is a first toolface angle in degrees, z is an nth toolface angle in degrees, and n is a number of measured toolface angles for the drilling operation.

The controller may be further configured to calculate an adjusted motor yield representing the maximum amount of curvature of a wellbore that the BHA is able to execute during the drilling operation using the calculated slide stability score. The controller may be further configured to use the slide stability score to automatically update a drill plan for the drilling operation.

The foregoing outlines features of several implementations so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the implementations introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. § 112(f) for any limitations of any of the claims herein, except for those in which the claim expressly uses the word "means" together with an associated function.

What is claimed is:

1. A method of operating a drilling system, comprising:

inputting a drill plan into a directional drilling system comprising a bottom hole assembly (BHA), the drill plan comprising a slide drilling operation;

conducting the slide drilling operation, comprising:

effecting an incident toolface angle of the BHA for a first distance of the slide drilling operation;

measuring a first toolface angle during the slide drilling operation;

comparing the measured first toolface angle to the incident toolface angle;

calculating an amount of consistency of the toolface angle over the first distance of the slide drilling operation based on the comparison of the measured first toolface angle to the incident toolface angle and a number of measured toolface angles for the first distance of the slide drilling operation; and displaying the amount of consistency of the toolface angle over the first distance of the slide drilling operation to an operator on a display device.

2. The method of claim 1, further comprising calculating an average toolface angle of the BHA over the first distance of the slide drilling operation, and displaying the average toolface angle of the BHA over the first distance of the slide drilling operation to the operator on the display device.

3. The method of claim 1, further comprising measuring a second toolface angle of the BHA over a second distance of the slide drilling operation;

comparing the measured second toolface angle to the incident toolface angle; and calculating a second amount of consistency of the toolface angle over the second distance during the slide drilling operation based on the comparison of the measured second toolface angle to the incident toolface angle.

4. The method of claim 3, wherein the second amount of consistency of the toolface angle is given as:

$$S = \sqrt{\left(\frac{\sin(a) + \sin(b) + \ldots + \sin(z)}{n}\right)^2 + \left(\frac{\cos(a) + \cos(b) + \ldots + \cos(z)}{n}\right)^2}$$

where S is the second amount of consistency of the toolface angle, a is the measured first toolface angle of the BHA in degrees, b is the measured second toolface angle of the BHA in degrees, z is a measured nth toolface angle of the BHA in degrees, and n is the number of measured toolface angles for the drilling operation.

5. The method of claim 4, further comprising determining an ideal maximum amount of curvature of a wellbore that the BHA is able to execute.

6. The method of claim 5, further comprising calculating a modified maximum amount of curvature of the wellbore that the BHA is able to execute during the slide drilling operation using the calculated amount of consistency of the toolface angle.

7. The method of claim 6, further comprising calculating the modified maximum amount of curvature in the wellbore by multiplying the amount of consistency of the toolface angle by the ideal maximum amount of curvature of the wellbore that the BHA is able to execute.

8. The method of claim 6, further comprising using the calculated amount of consistency of the toolface angle to automatically update the drill plan for the slide drilling operation.

9. A method of measuring data of a drilling operation, comprising:

conducting a drilling operation with a directional drilling system comprising a drilling rig, one or more sensors, a controller, and a bottom hole assembly (BHA);

measuring, with the one or more sensors, one or more toolface angles of the BHA during the drilling operation;

calculating, with the controller, a slide stability score for the drilling operation based on at least sine and cosine values of the measured one or more toolface angles, the slide stability score representing an amount of consistency of the toolface angle during the drilling operation; and displaying the slide stability score to an operator on a display device.

10. The method of claim 9, wherein the slide stability score is given as:

$$S = \sqrt{\left(\frac{\sin(a) + \ldots + \sin(z)}{n}\right)^2 + \left(\frac{\cos(a) + \ldots + \cos(z)}{n}\right)^2}$$

where S is the slide stability score, a is a first toolface angle in degrees, z is an nth toolface angle in degrees, and n is a number of measured toolface angles for the drilling operation.

11. The method of claim 9, further comprising determining an initial motor yield representing an ideal maximum amount of curvature of a wellbore that the BHA is able to execute.

12. The method of claim 11, further comprising calculating an adjusted motor yield representing the maximum amount of curvature of the wellbore that the BHA is able to execute during the drilling operation using the calculated slide stability score.

13. The method of claim 12, further comprising calculating the adjusted motor yield by multiplying the slide stability score by the initial motor yield.

14. The method of claim 10, further comprising using the slide stability score to automatically update a drill plan for the drilling operation.

15. A drilling apparatus comprising:

a drill string comprising a plurality of tubulars;

a bottom hole assembly (BHA) disposed at a distal end of the drill string;

a sensor system connected to the BHA and configured to measure a toolface angle of the BHA;

a controller in communication with the BHA and the sensor system, wherein the controller is configured to:

determine one or more toolface angles of the BHA during a drilling operation; and calculate a slide stability score for the drilling operation based on at least sine and cosine values of the measured one or more toolface angles, the slide stability score representing an amount of consistency of the toolface angle during the drilling operation; and a display device configured to display the slide stability score to a user.

16. The drilling apparatus of claim 15, wherein the toolface angles are azimuth values between 0 and 360 degrees.

17. The drilling apparatus of claim 15, wherein the controller is further configured to update the slide stability score in real time based on the measured one or more toolface angles.

18. The drilling apparatus of claim 15, wherein the slide stability score is given as:

$$S = \sqrt{\left(\frac{\sin(a) + \ldots + \sin(z)}{n}\right)^2 + \left(\frac{\cos(a) + \ldots + \cos(z)}{n}\right)^2}$$

where S is the slide stability score, a is a first toolface angle in degrees, z is an nth toolface angle in degrees, and n is a number of measured toolface angles for the drilling operation.

19. The drilling apparatus of claim 18, wherein the controller is further configured to calculate an adjusted motor yield representing the maximum amount of curvature of a wellbore that the BHA is able to execute during the drilling operation using the calculated slide stability score.

20. The drilling apparatus of claim 18, wherein the controller is further configured to use the slide stability score to automatically update a drill plan for the drilling operation.

* * * * *